US011428420B2

(12) United States Patent
Sung et al.

(10) Patent No.: US 11,428,420 B2
(45) Date of Patent: Aug. 30, 2022

(54) OUTDOOR UNIT AND AIR CONDITIONER INCLUDING THE SAME

(71) Applicant: LG Electronics Inc., Seoul (KR)

(72) Inventors: Sangjin Sung, Seoul (KR); Dongsoo Lee, Seoul (KR); Sunghyun Ki, Seoul (KR); Seungyup Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 249 days.

(21) Appl. No.: 16/811,950

(22) Filed: Mar. 6, 2020

(65) Prior Publication Data

US 2020/0284446 A1 Sep. 10, 2020

(30) Foreign Application Priority Data

Mar. 8, 2019 (KR) ..... 10-2019-0027115

(51) Int. Cl.
*F24F 1/40* (2011.01)
*F24F 1/32* (2011.01)
*F24F 1/56* (2011.01)

(52) U.S. Cl.
CPC ..... *F24F 1/40* (2013.01); *F24F 1/32* (2013.01); *F24F 1/56* (2013.01)

(58) Field of Classification Search
CPC ..... F24F 1/12; F24F 1/40; F24F 1/56; F24F 1/58; F24F 2013/242
See application file for complete search history.

(56) References Cited

U.S. PATENT DOCUMENTS 2,130,327 A * 9/1938 Galson ..... F24F 1/022 62/262
2,236,111 A * 3/1941 Philipp ..... F25D 23/003 62/508
4,493,390 A * 1/1985 Pagano ..... F02B 77/11 181/204
4,991,406 A * 2/1991 Fujii ..... F24F 1/56 62/259.1

(Continued)

FOREIGN PATENT DOCUMENTS

CN 2553292 5/2003
CN 208419009 U 1/2019

(Continued)

OTHER PUBLICATIONS

EP Office Action in European Appln. No. 20161467.4, dated Feb. 1, 2021, 6 pages.

(Continued)

*Primary Examiner* — Christopher R Zerphey
(74) *Attorney, Agent, or Firm* — Fish & Richardson P.C.

(57) ABSTRACT

There is disclosed an outdoor unit an outdoor unit that may attach a cover to a case by using a magnetic member and have an empty space formed between the case and the cover as large as the thickness of the magnetic member, wherein air or a sound-proof or meta material may be filled in the empty space and a cover for covering the case of the outdoor unit may include several pieces that are detachably connected with each other like Lego pieces, and the cover may be attached to the other area of an outer surface of the outdoor unit except the area having an inlet for sucking external air and an outlet hole for discharging the external air drawn into the outdoor unit via the inlet outside again.

17 Claims, 9 Drawing Sheets

(56) References Cited

U.S. PATENT DOCUMENTS

| | | | | |
|---|---|---|---|---|
| 5,158,486 | A * | 10/1992 | Tamame | F24F 13/20 160/368.1 |
| 5,274,200 | A * | 12/1993 | Das | E04B 1/8218 415/119 |
| 5,669,232 | A * | 9/1997 | Iwamoto | F25D 23/00 62/505 |
| 5,965,851 | A * | 10/1999 | Herreman | B32B 5/26 181/200 |
| 6,397,617 | B1 * | 6/2002 | Johnson | E05C 19/16 49/465 |
| 7,490,697 | B1 * | 2/2009 | Williamson, Jr. | G10K 11/16 181/204 |
| 8,357,031 | B2 * | 1/2013 | Dinicolas | F24F 1/58 454/201 |
| 8,579,073 | B2 * | 11/2013 | Sheng | G10K 11/172 181/207 |
| 8,833,510 | B2 * | 9/2014 | Koh | G10K 11/04 181/207 |
| 9,063,405 | B2 * | 6/2015 | Clawson | G03B 21/585 |
| 9,163,398 | B2 * | 10/2015 | Varanasi | G10K 11/168 |
| 9,299,332 | B2 * | 3/2016 | Je | G10K 11/002 |
| 9,762,994 | B2 * | 9/2017 | Mathur | H04R 1/26 |
| 10,424,286 | B2 * | 9/2019 | Chattell | B32B 17/10 |
| 10,982,864 | B2 * | 4/2021 | Almaoula | F24F 1/58 |
| 11,105,516 | B2 * | 8/2021 | Chothave | F24F 1/022 |
| 2008/0099274 | A1 * | 5/2008 | Seel | H02K 5/24 181/202 |
| 2009/0145153 | A1 * | 6/2009 | Moynihan | F24F 1/58 62/259.1 |
| 2013/0174882 | A1 | 7/2013 | Ellenbecker | |
| 2015/0023728 | A1 * | 1/2015 | Buswell | F24F 3/0442 403/270 |
| 2017/0051927 | A1 * | 2/2017 | Johnson | F24F 1/58 |
| 2018/0080678 | A1 * | 3/2018 | Carton | F24F 13/06 |
| 2020/0232660 | A1 * | 7/2020 | Fujiwara | F24F 1/40 |
| 2021/0033290 | A1 * | 2/2021 | Watanabe | F04B 39/00 |

FOREIGN PATENT DOCUMENTS

| | | |
|---|---|---|
| EP | 3147582 | 3/2007 |
| JP | 2009168305 | 7/2009 |
| JP | 2013088794 | 5/2013 |
| JP | 2014040931 | 3/2014 |
| KR | 1020060086761 | 8/2006 |
| KR | 1020170112449 | 10/2017 |
| WO | WO2018193520 | 10/2018 |

OTHER PUBLICATIONS

Extended European Search Report in European Application No. 20161467.4, dated Jun. 9, 2020, 5 pages.

Korean Office Action in Korean Application No. 10-2019-0027115, dated May 27, 2020, 10 pages (with English translation).

* cited by examiner

OUTDOOR UNIT AND AIR CONDITIONER INCLUDING THE SAME

CROSS-REFERENCE TO RELATED APPLICATIONS

This application claims priority to Korean Patent Application No. 10-2019-0027115, filed on Mar. 8, 2019, the entire contents of which is hereby incorporated by reference in its entirety.

BACKGROUND OF THE DISCLOSURE

Embodiments of the present disclosure relate to an air conditioner, more particularly, an air conditioner that may reduce the noise and vibration generated in an outdoor.

An air conditioner is an air conditioning/heating device that includes a blowing fan configured to suck and discharge air and a heat-exchanger configured to exchange heat with the sucked air so as to heat or air-condition an a room by means of the air repeatedly discharged into the room after exchanging heat with a low-temperature or high-temperature refrigerant. Such an air conditioner may form a series of cycles configured of a compressor, a condenser, an expansion valve and an evaporator.

Generally, an outdoor unit of such the air conditioner may include an outdoor heat-exchanger configured to exchange heat between a refrigerant flowing therein and external air sucked therein; an outdoor fan installed near the outdoor heat exchanger and configured to provide a power used in sucking and discharging the external air; and a compressor configured to compress a low-temperature-low-pressure gas refrigerant into a high-temperature-and-high-pressure gas refrigerant.

When the air conditioner is used in supplying chilled air to a room, the high-temperature-and-high-pressure gas refrigerant generated in the compressor is transmitted to the outdoor unit heat-exchanger and exchanges heat with outdoor air to be condensed. The condensed liquid refrigerant exchanges heat with room air while passing the indoor heat-exchanger to be evaporated. The room air having relieved of heat by the refrigerant is chilled and supplied to the room In contrast, when the air conditioner is used in supplying heated-air to the room, the high-temperature-and-high-pressure gas refrigerant is transmitted to the indoor unit heat-exchanger and exchanges heat with room air to be condensed. At this time, the room air sucked into the indoor unit heat-exchanger exchanges heat with the refrigerant and heated, and the heated-air is supplied to the room.

In such a series of processes, the compressor and outdoor unit fan installed in the outdoor unit cannot but generate relatively much noise and vibration.

SUMMARY OF THE DISCLOSURE

Accordingly, an object of the present disclosure is to address the above-noted and other problems.

Another object of the present disclosure is to provide an outdoor unit that may reduce the noise and vibration generated in an outdoor unit of an air conditioner, and an air conditioner including the same.

Another object of the present disclosure is to provide an outdoor unit including a cover that may be mounted therein and demounted therefrom simply and easily, and an air conditioner including the same.

Another object of the present disclosure is to provide an outdoor unit that may be mounted or demounted by means of a plurality of covers assembled based on the size of the outdoor unit, with no need of a new cover even if the outdoor unit has a different size, and an air conditioner including same.

Another object of the present disclosure is to provide an outdoor unit that that may effectively reduce the noise and vibration generated therein, through interfering win a path of external air passing the outdoor unit, and an air conditioner including the same.

Embodiments of the present disclosure may provide an outdoor unit that may attach a cover to a case by using a magnetic member and have an empty space formed between the case and the cover as large as the thickness of the magnetic member, wherein air or a sound-proof or meta material may be filled in the empty space and a cover for covering the case of the outdoor unit may include several pieces that are detachably connected with each other like Lego pieces, and the cover may be attached to the other area of an outer surface of the outdoor unit except the area having an inlet for sucking external air and an outlet hole for discharging the external air drawn into the outdoor unit via the inlet outside again.

Embodiments of the present disclosure may also provide an outdoor unit including an outdoor unit of an air condition configured to supply heating and cooling to a room, the outdoor unit including a case provided to define an exterior design and including a heat-exchanging chamber and a mechanism chamber; an inlet hole formed through the case and providing a path of external air drawn into the heat-exchanging chamber; an outlet hole formed through the case and providing a path of the external air drawn into the heat-exchanging chamber outside; a cover configured to cover the other predetermined area of an outer surface of the case except an area having the inlet hole and the outlet hole; and a magnetic member disposed between the case and the cover and configured to secure the cover to the case by means of a magnetic force. The case and the cover may be spaced a preset distance apart from each other by the magnetic member disposed between the case and the cover.

The cover may be separable from the case, when a stronger power than an attractive force formed between the case and the magnetic member is applied in a direction getting farther from the case.

The cover may include a first sub-cover and a second sub-cover that are detachably connected with each other, and the first sub-cover may cover a predetermined area of the case and the second sub-cover covers another predetermined area of the case, and one of the first and second sub-covers may cover a side surface of the case and the other one covers side surface and upper surfaces of the case.

The magnetic member may be coupled to an inner surface of the cover.

The magnetic member may extend in a first direction and a plurality of magnetic members area may be arranged at preset intervals along a second direction crossing the first direction.

Air may be filled in the other empty space between the case and the cover except the area having the magnetic member.

At least one of a sound-proof material for reducing noise and vibration and a meta material having a refractive index of sound may be filled in the other empty space between the case and the cover except the area having the magnetic member.

The sound-proof material may include a sound absorbent material for absorbing noise and vibration and a sound insulating material for insulating noise.

The sound-proof material may be coupled to an inner surface of the cover, spaced a preset distance apart from the case.

Air may be filled in the other empty space between the sound-proof material and the case except the area having the magnetic member.

The sound-proof material may be spaced a preset distance apart from an inner surface of the cover and contact with an outer surface of the case, when the cover is attached to the case.

The meta material may be coupled to an inner surface of the cover and spaced apart a preset distance apart from the case.

Air may be filled in the other empty space between the cover and the sound-proof material except the area having the magnetic member.

The meta material may be spaced a preset distance apart from an inner surface of the cover and contacts with an outer surface of the case, when the cover is attached to the case.

The outdoor unit may further include a porous structure installed in the other empty space between the case and the cover except the area having the magnetic member and having the sound-proof material and the meta material alternately layered thereon in a direction from the case towards the cover, the porous structure in which a plurality of empty spaces are formed between the case and the cover to fill air therein.

Embodiments of the present disclosure may also provide an air conditioner including an outdoor unit including a case provided to define an exterior design and including a heat-exchanging chamber and a mechanism chamber; an inlet hole formed through the case and providing a path of external air drawn into the heat-exchanging chamber; an outlet hole formed through the case and providing a path of the external air drawn into the heat-exchanging chamber outside; a cover configured to cover the other predetermined area of an outer surface of the case except an area having the inlet hole and the outlet hole; and a magnetic member disposed between the case and the cover and configured to secure the cover to the case by means of a magnetic force; and an indoor unit connected with the outdoor unit via a refrigerant path and configured to facilitate heat-exchanging between internal air and a refrigerant transmitted from the outdoor unit and transmit the refrigerant to the outdoor unit again, and wherein the case and the cover may be spaced a preset distance apart from each other by the magnetic member disposed between the case and the cover, and the indoor unit may provide heating to a room when the refrigerant passing through the indoor unit absorbs heat from the room air and cooling to the room when the refrigerant passing through the indoor unit supplies heat to the room.

According to the embodiment of the present disclosure, the present disclosure has the effect of providing the air conditioner that may attach and detach a cover capable of reducing noise and vibration of the outdoor unit to the case of the outdoor unit simply and enhancing the user and service technician's working convenience.

In addition, the present disclosure has the effect of effectively reducing the noise and vibration generated in the outdoor unit by filling air or a sound-proof or meta material in the empty space formed between the case and the cover as much as the thickness of the magnetic member.

In addition, the present disclosure has the effect of forming the case configured of several parts like Lego to cover the case, with no need of the new cover. Accordingly, the manufacturing cost may be reduced. Also, such the covers may be assembled based on the size of the outdoor unit properly to be attached to or detached from the outdoor unit. Accordingly, the cover may be versatile.

In addition, the present disclosure has the effect of effectively reducing the noise and vibration generated therein, through interfering win a path of external air passing the outdoor unit, by attaching the cover to the other outer surface of the case except the inlet hole for sucking the external air and the outlet hole for discharging the air sucked into the outdoor unit.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and reference numerals means structural elements and wherein.

DESCRIPTION OF SPECIFIC EMBODIMENTS

Hereinafter, referring to the accompanying drawings, exemplary embodiment of a compressor according to the present disclosure will be described. Regardless of numeral references, the same or equivalent components may be provided with the same reference numbers and description thereof will not be repeated.

Terms such as "include" or "has" are used herein and should be understood that they are intended to indicate an existence of several components, functions or steps, disclosed in the specification, and it is also understood that greater or fewer components, functions, or steps may likewise be utilized.

For the sake of brief description with reference to the drawings, the sizes and profiles of the elements illustrated in the accompanying drawings may be exaggerated or reduced and it should be understood that the embodiments presented herein are not limited by the accompanying drawings.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Referring to the accompanying drawings, embodiments of the present disclosure will be described in detail.

Figure 1:
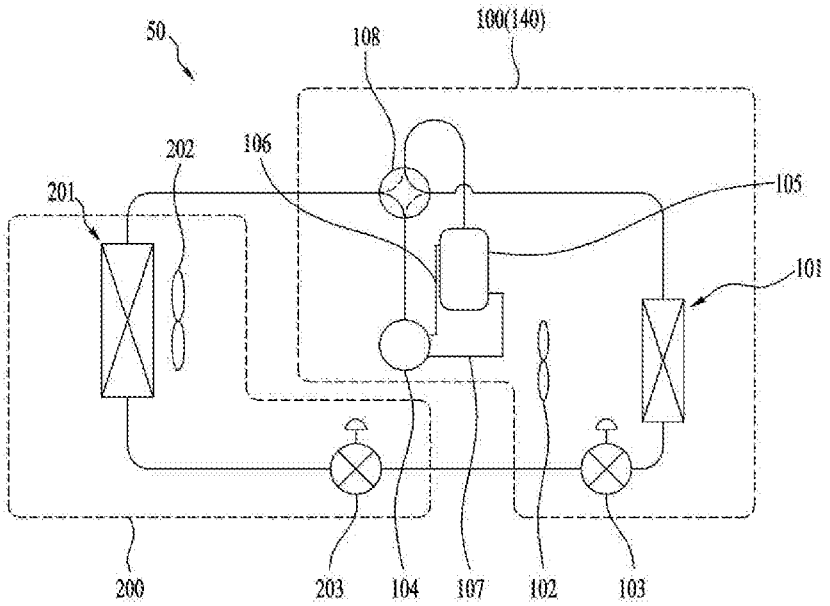
FIG. 1 is a conceptual diagram schematically illustrating a structure of an air conditioner including an outdoor unit according to one embodiment of the present disclosure.

FIG. 1 is a conceptual diagram schematically illustrating a structure of an air conditioner including an outdoor unit according to one embodiment of the present disclosure.

Referring to FIG. 1, the air conditioner 50 according to one embodiment of the present disclosure may include an outdoor unit 100 and an indoor unit 200.

The outdoor unit 100 may include an outdoor unit heat-exchanger 101 configured to exchange heat between external door and a refrigerant; an outdoor unit fan 102 provided adjacent to the outdoor unit heat-exchanger 101; a first expansion valve 103 configured to expand the refrigerant drawn into the outdoor unit heat-exchanger 101; and a compressor 104 configured to compress the refrigerant discharged from the outdoor unit heat-exchanger 101.

The indoor unit 200 may include an indoor unit heat-exchanger 201 configured to suck the refrigerant discharged from the compressor 104; an indoor unit fan 202 provided adjacent to the indoor unit heat-exchanger 201; and a second expansion valve 203 configured to adjust the amount of the refrigerant sucked into the indoor unit heat-exchanger 201.

The compressor 104 may be formed to compress the refrigerant. In other words, the compressor 104 may press a low-temperature-and-low-pressure refrigerant into a high-temperature-and-high-pressure refrigerant. One or more compressors 104 may be provided in the air conditioner 50.

As one example, when a plurality of compressors 104 are provided in the air conditioner 50, the plurality of the compressors 104 may be arranged long a flowing direction of the refrigerant in serial and/or parallel.

The indoor unit heat-exchanger 201 may be configured to exchange heat with room air. In other words, the indoor unit heat-exchanger 201 may exchange heat between the room air and the refrigerant flowing into the indoor unit heat-exchanger 201.

As one example, the indoor unit heat-exchanger 201 may function as the evaporator in a cooling mode of the air conditioner 50 and the function as the condenser in a heating mode. Also, a plurality of indoor unit heat-exchangers 102 may be provided in one indoor unit or respective indoor units.

The outdoor unit heat-exchanger 101 may be configured to exchange heat with external air. In other words, the outdoor unit heat-exchanger 101 may exchange heat between external air and the refrigerant flowing into the outdoor unit heat-exchanger 101.

As one example, the outdoor unit heat-exchanger 101 may function as the condenser in the cooling mode and the evaporator in the heating mode. Also, a plurality of the outdoor unit heat-exchangers 101 may be provided in one outdoor unit or respective outdoor units.

The outdoor unit heat-exchanger 101 and the indoor unit heat-heat exchanger 201 may be a fin-tube type heat-exchanger. The outdoor unit fan 102 may be provided in the outdoor unit heat exchanger 101 and the indoor unit fan 202 may be provided in the indoor unit heat-exchanger 201.

The air conditioner 50 may include an oil separator 105 configured to separate oil from the mixed air of the refrigerant and oil discharged from the compressor 104 and supply the oil to the compressor 104 again.

The refrigerant separated from the mixed air drawn into the oil separator 105 may circulate in a refrigerant cycle having the outdoor unit heat-exchanger 101 and the indoor unit heat-exchanger 201.

As one example, the mixed air discharged from the compressor 104 may be supplied to the oil separator 105 via a supply path 106. The liquid oil separated by the oil separator 105 may be resupplied to the compressor 104 via a return path 107. The gas refrigerant separated by the oil separator 105 may circulate in a refrigerant cycle.

The air conditioner 50 may include a flow-path changing valve for changing a flow path of the refrigerant, when the cooling mode and the heating mode are converted into each other. The flow path changing valve 108 may be 4-way valve.

As one example, the flow path changing valve 108 may guide the refrigerant discharged from the compressor into the outdoor unit 100 in the cooling mode and into the indoor unit 200 in the heating mode.

The first expansion valve 103 may be provided in the outdoor unit 100 and configured to expand the refrigerant drawn into the outdoor unit heat-exchanger 101 when the air conditioner 50 is operated in the heating mode and be full-open when the air conditioner 50 is operated in a defrost or cooling mode.

The second expansion valve 203 may be provided in the indoor unit 200 and configured to adjust an opening degree to adjust the amount of the refrigerant flowing in the indoor unit 200 based on an outdoor temperature and a heating-set temperature when the air conditioner 50 is operated in the heating mode.

In addition, the second expansion valve 203 may be configured to expand the refrigerant drawn into the indoor unit heat-exchanger 201 and adjust the opening degree to adjust the amount of the refrigerant, when the air conditioner 50 is operated in the defrost or cooling mode.

FIG. 1 illustrates one example of a mechanism device in which a cover (140, see FIG. 3) according to one embodiment may be installed. The cover 140 may be provided to cover an outer surface of the outdoor unit 100, which will be described later in detail. To show that such a feature in FIG. 1, a numeral reference of 140 is added in a rear portion of the outdoor unit 100.

Figure 2:
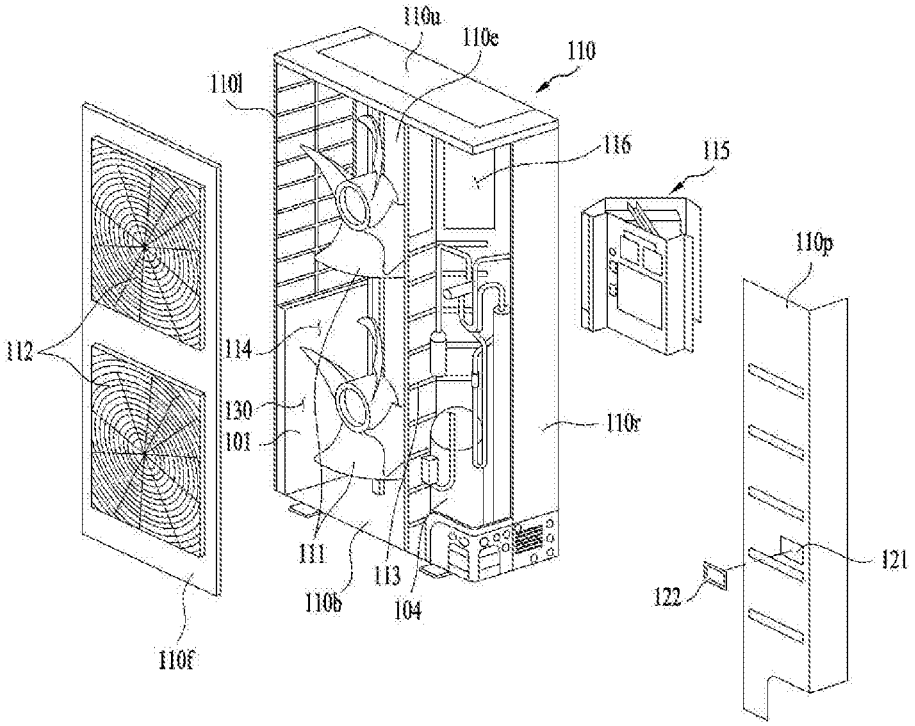
FIG. 2 is a perspective diagram illustrating the outdoor unit shown in FIG. 1.

FIG. 2 is an exploded perspective diagram of the outdoor unit shown in FIG. 1.

Referring to FIGS. 1 and 2, the outdoor unit 100 may be connected with the indoor unit 200 via a refrigerant pipe unit 300 to facilitate the supply and return of the refrigerant. The outdoor unit 100 may be installed outdoor in a state of standing.

The outdoor unit 100 may be defined by a case 110. The case 110 may have a grill 112 arranged in a corresponding position to a fan 111. The case 110 may include a front panel 110*f* for shielding a heat-exchanging chamber 114, a panel 110*p* for defining a front of a mechanical chamber 116, upper and lower plates 110*u* and 110*b* for defining upper and lower surfaces of the outdoor unit 100, respectively, right and left plates 110*r* and 1101 for defining right and left surfaces, respectively, and a rear panel 110*e* for defining a rear surface.

At least one of the above-noted elements may be formed as one body integrally connected with each other. The elements may be coupled to each other to define the exterior design of the outdoor unit 100.

Meanwhile, the inside of the case 110 may be partitioned off by a barrier 113. The spaces partitioned off by the barrier 113 may include a heat-exchanging chamber 114 for accommodating the outdoor unit heat-exchanger 101; and a mechanism chamber 116 for accommodating the compressor 104, the refrigerant pipe unit 300 and a control box 115.

In a predetermined area of the case corresponding to the heat-exchanging chamber 114 may be sequentially formed an inlet hole 120 for sucking external air and an outlet hole 130 for discharging the external air outside after passing the heat-exchanger 101 so as to facilitate the heat exchanging between the outdoor unit heat-exchanger 101 and the external air. Also, in a predetermined area inside the heat-exchanger 114 corresponding to the grill 112 may be mounted a fan motor assembly configured of the fan 111 and a fan motor (not shown).

Accordingly, external air may be drawn via the inlet hole 120 by the rotation of the fan 111 and supplied to the inside of the heat-exchanging chamber 114 via the outdoor unit heat-exchanger 101. At this time, the refrigerant flowing inside the outdoor unit heat-exchanger 101 may exchange heat with the external air.

Meanwhile, the other predetermined area of the case corresponding to the mechanism chamber 116 may be formed to be partially open. The open mechanism chamber 116 may be closed by the panel 110*p*. Under the structure, a user or service technician may separate the panel 110*p* from the case 110 to access to the control box 115, when trying to repair the control box 115 installed in the mechanism chamber 116.

The control box 115 may be configured to control diverse operations of the outdoor unit 100 and installed in the mechanism chamber 116. Such the control box 115 may be independently installed in a predetermined area of the mechanism chamber 116 not to interfere in the other elements. As shown in the drawing, the control box 115 may be installed in the uppermost area of the mechanism chamber 116 but embodiments are not limited thereto. As one example, the control box 115 may be installed in a position that is high enough to facilitate the user's or service technician's work.

The compressor 104 may be installed in another space in the mechanism chamber 116, independently separated from the control box 115. Generally, heat and noise consistently occur in the compressor 104 while the outdoor unit 100 is operating. To prevent the error caused by the heat of the control box 104, the compressor 104 may be installed distant from the control box 115 as far as possible.

The compressor 104 may be connected with the outdoor unit heat-exchanger 101 and the indoor unit 200 by the refrigerant pipe unit 300, such that some of the refrigerant pipe unit 300 may be installed and supported in the mechanism chamber 116.

Specifically, the refrigerant pipe unit 300 may include a liquid pipe 310 and a gas pipe 320 that are connected with the indoor unit 200 through the case 110. Service valves 330 may be installed in the liquid pipe 310 and the gas pipe 320, respectively. In other words, a pair of service valves 330 may be provided to connect the liquid pipe 310 and the gas pipe 320 with each other so as to connect the outdoor unit heat-exchanger 101 with the indoor unit heat-exchanger 201.

Also, the service valves 330 may be closable. A refrigerant may be filled or recharged in the refrigerant pipe unit 300 or discharged therefrom, in a state where the service valves 330 are open. For that, the service valves 330 may be exposed outside the outdoor unit 100 to facilitate the easy opening and closing and the connection with the liquid pipe 310 and the gas pipe 320 connected with the indoor unit 200.

If necessary, an opening 121 may be formed in the panel 110*p* to expose the service valves 330 outside. A cover 122 may be coupled to the opening 121 such that the user or service technician can manipulate the cover 122 to open and close the opening 121.

Meanwhile, although not shown in the drawings, diverse valves, a drier, an accumulator and the like may be installed in the mechanism chamber 116. Such elements may be the conventional elements composing the outdoor unit 100 of the air conditioner 50 and detailed description thereof is omitted accordingly.

In addition, plural electric control parts as well as the first expansion valve 104 and the compressor 104 may be mounted in the mechanism chamber 116 and a plurality of wires (not shown) for supply power or transmit a signal to the electric control parts may be also installed.

Hereinafter, referring to FIGS. 3 through 14, a coupling structure between the cover 140 installed in the outdoor unit 100 and the case 110 and the cover 140 provided in the outdoor unit 100 will be described in detail.

Figure 3:
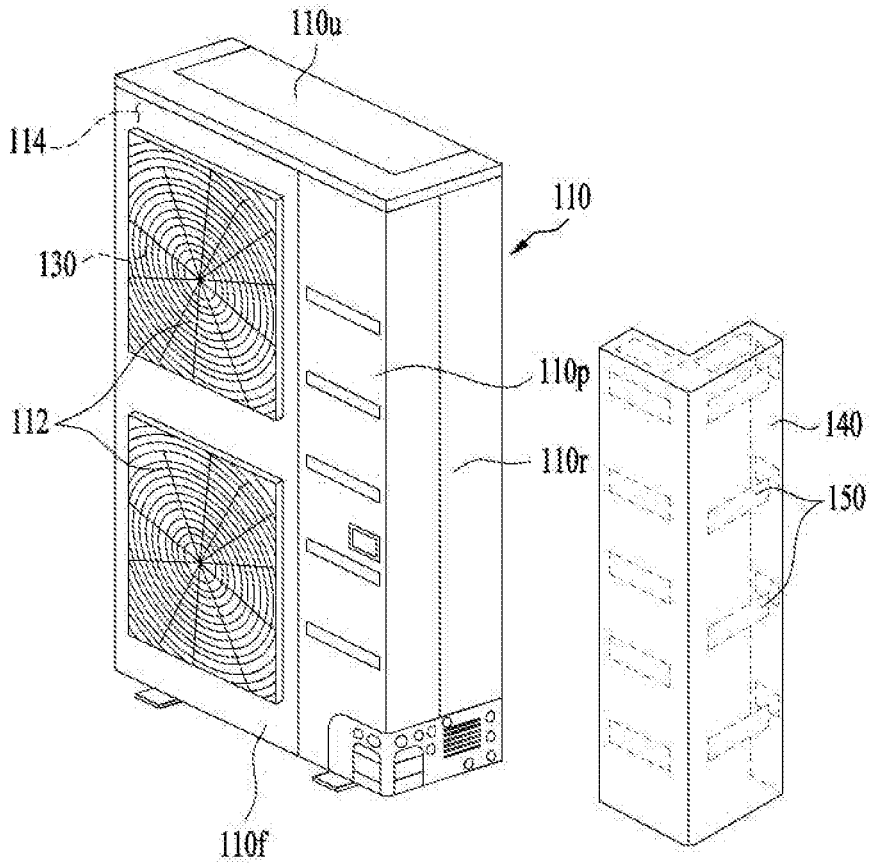
FIG. 3 is a perspective diagram illustrating the outdoor unit and a cover that is attachable to the outdoor unit shown in FIG. 2.
Figure 4:
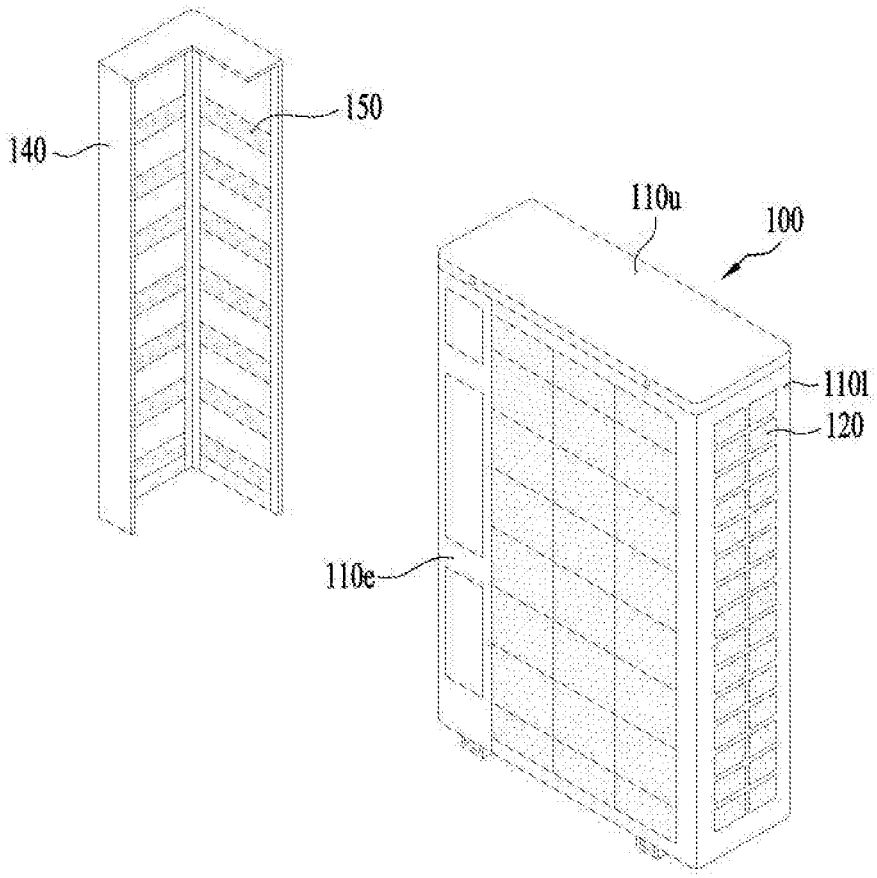
FIG. 4 is a perspective diagram illustrating the cover and the outdoor unit shown in FIG. 3, viewed from a different side.
Figure 5:
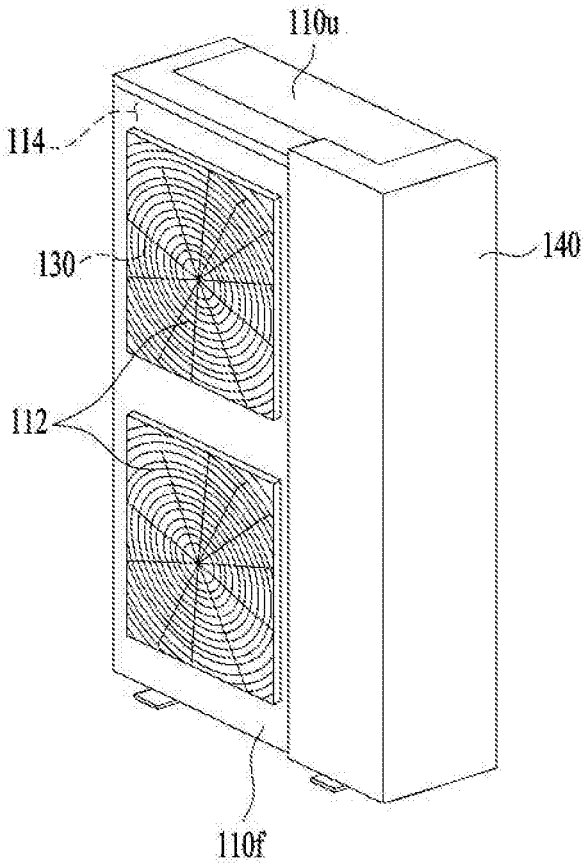
FIG. 5 is a perspective diagram illustrating the cover of FIGS. 3 and 4 that is attached to the outdoor unit.
Figure 6:
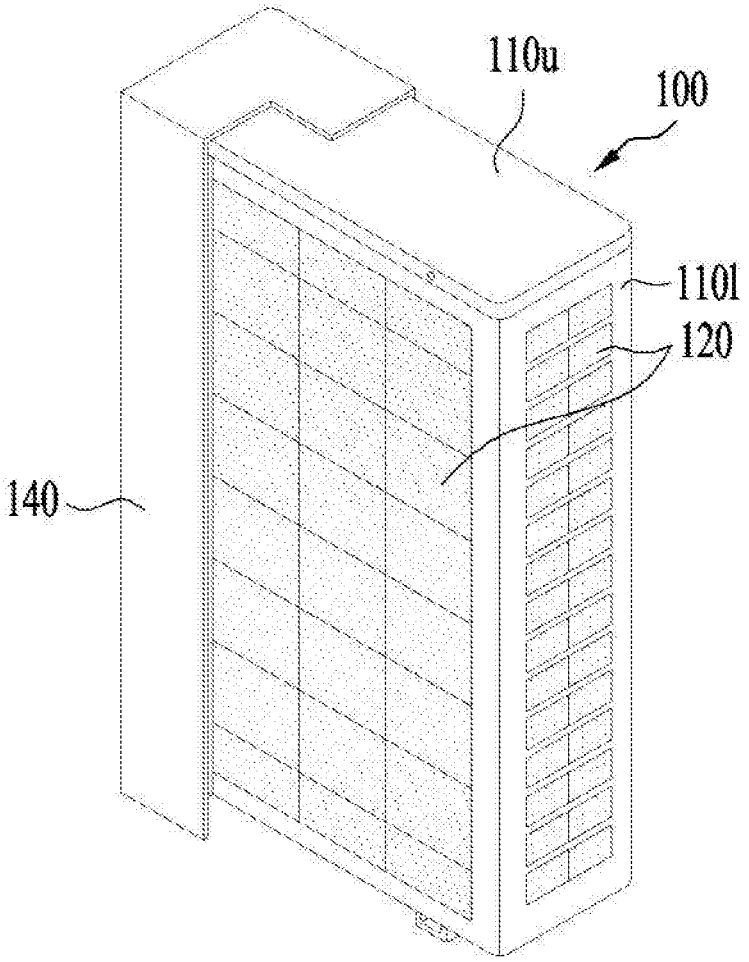
FIG. 6 is a perspective diagram illustrating the cover and the outdoor unit of FIG. 5 that are coupled to each other, viewed from a different side.

FIG. 3 is a perspective diagram illustrating the outdoor unit and a cover that is attachable to the outdoor unit shown in FIG. 2. FIG. 4 is a perspective diagram illustrating the cover and the outdoor unit shown in FIG. 3, viewed from a different side. FIG. 5 is a perspective diagram illustrating the cover of FIGS. 3 and 4 that is attached to the outdoor unit. FIG. 6 is a perspective diagram illustrating the cover and the outdoor unit of FIG. 5 that are coupled to each other, viewed from a different side.

Referring to FIGS. 3 through 6, the outdoor unit 100 may further include a cover covering at least predetermined area of an outer surface of the case except the inlet hole 120 and the outlet hole 130; and a magnetic member 150 disposed between the outer surface of the case 110 and the cover 140 and configured to secure the cover 140 covering the case 110 by means of a magnetic force.

Here, the expression of 'at least predetermined' means that the cover 140 may be installed to cover some area of the outer surface of the case 110 except the inlet hole 120 and the outlet hole 130. However, the embodiments are not limited thereto.

As one example, although not shown in the drawings, the cover 140 may be provided in the case to cover the other area of the outer surface of the case except the inlet hole 120 and the outlet hole 130. In other words, although not shown in the drawings, the case 140 may be provided to cover the overall surface of the upper plate 110*u* provided in the case 110. Hereinafter, for easy description, the cover 140 may be coupled to the case 110 to cover a predetermined area of the outer surface of the case 110, except the inlet hole 120 and the outlet hole 130, specifically, a predetermined area of the front panel 110*f*, the right and upper plates 110*r* and 110*u*.

More specifically, the magnetic member 150 may be provided as an independent member from the case 110 or the cover 140 such that the user or service technician may attach the magnetic member 150 to the outer surface of the case 110 and the cover 140 to the magnetic member 150 after that, to couple the cover 140 to the case 110. Alternatively, the magnetic member 150 may be fabricated in a state of being coupled to an inner surface of the cover such that the user or service technician can attach the cover to the case 110 immediately.

Here, the expression of 'attaching the cover 140 to the case 110' means a structure that the cover 140 and the case 110 directly contact with each other and a structure that the cover 140 keeps a secured state with respect to the case 110, spaced a preset distance apart by means of the magnetic force of the magnetic member 150 disposed between the case 110 and the cover 140 (in the entire specification).

Based on the understanding, the cover 140 may be separated from the case 110 when a stronger power than an attractive force formed between the case 110 and the magnetic member 150 is applied in a direction getting farther from the case 110.

As mentioned above, the expression of 'the cover 140 is separated from the case 110 includes not only the structure configured to directly contact the case 110 with the cover 140 but also the structure configured to separate the cover 140 and the magnetic member 150 from the case 110, in a state where the cover 140 is secured to the outer surface of the case 110, spaced a preset distance apart from the case by means of the magnetic member 150 (in the entire specification).

Meanwhile, the magnetic member 150 may extend in a first direction and a plurality of magnetic members 150 may be arranged along a second direction crossing the first direction at preset intervals. In FIGS. 3 through 6, an air discharging direction of the outlet hole may be a width direction of the outdoor unit 100 and a horizontal direction crossing the width direction may be a longitudinal direction of the outdoor unit 100. A direction crossing the width direction and the longitudinal direction of the outdoor unit 100 may be a height direction. In this instance, the first direction may mean the longitudinal direction and the width direction of the outdoor unit 100. The second direction may mean the height direction of the outdoor unit 100.

In other words, the magnetic member 150 may extend along the longitudinal and width directions of the outdoor unit 100 and the plurality of the magnetic members 150 may be arranged at preset intervals along the height direction crossing the longitudinal and width directions.

In contrast, although not shown in the drawings, the first direction may mean the height direction of the outdoor unit 100 and the second direction may mean the length and width directions of the outdoor unit 100. In other words, the magnetic member 150 may extend along the height direction of the outdoor unit 100 and the plurality of the magnetic members 150 may be arranged along the longitudinal and width directions of the outdoor unit 100 side by side at predetermined intervals.

Under the above-noted structure, the other empty space between the case 110 and the cover 140, except the space having the magnetic member 150, may be filled with air or a sound-proof or meta material may be installed therein to reduce the noise and vibration generated in the outdoor unit 100.

Specifically, an empty space that is as large as the thickness of the magnetic member 150 may be formed between the case 110 and the cover 140. The empty space may be filled with the air or the sound proof or meta material such that the noise and vibration generated in the outdoor unit 100 may be effectively reduced.

In addition, the worker or service technician may simply attach or detach the cover for reducing the noise and vibration of the outdoor unit 100 to or from the case 110 of the outdoor unit 100 so as to enhance working convenience.

Alternatively, the cover 140 may be attached to the other area of the outer surface of the case, except the area having the inlet hole 120 for sucking external air and the outlet hole 130 for re-discharging the external air drawn into the outdoor unit 100 via the inlet hole 120, such that the noise and vibration generated in the outdoor unit 100 may be effectively reduced in a state of not interfering in the path of the air passing the outdoor unit 100.

Detailed description of the structure for reducing the noise and vibration of the outdoor unit 100 will be described later, referring to FIGS. 8 through 14. Hereinafter, referring to FIG. 7, the versatile utility of the cover will be described in detail.

Figure 7:
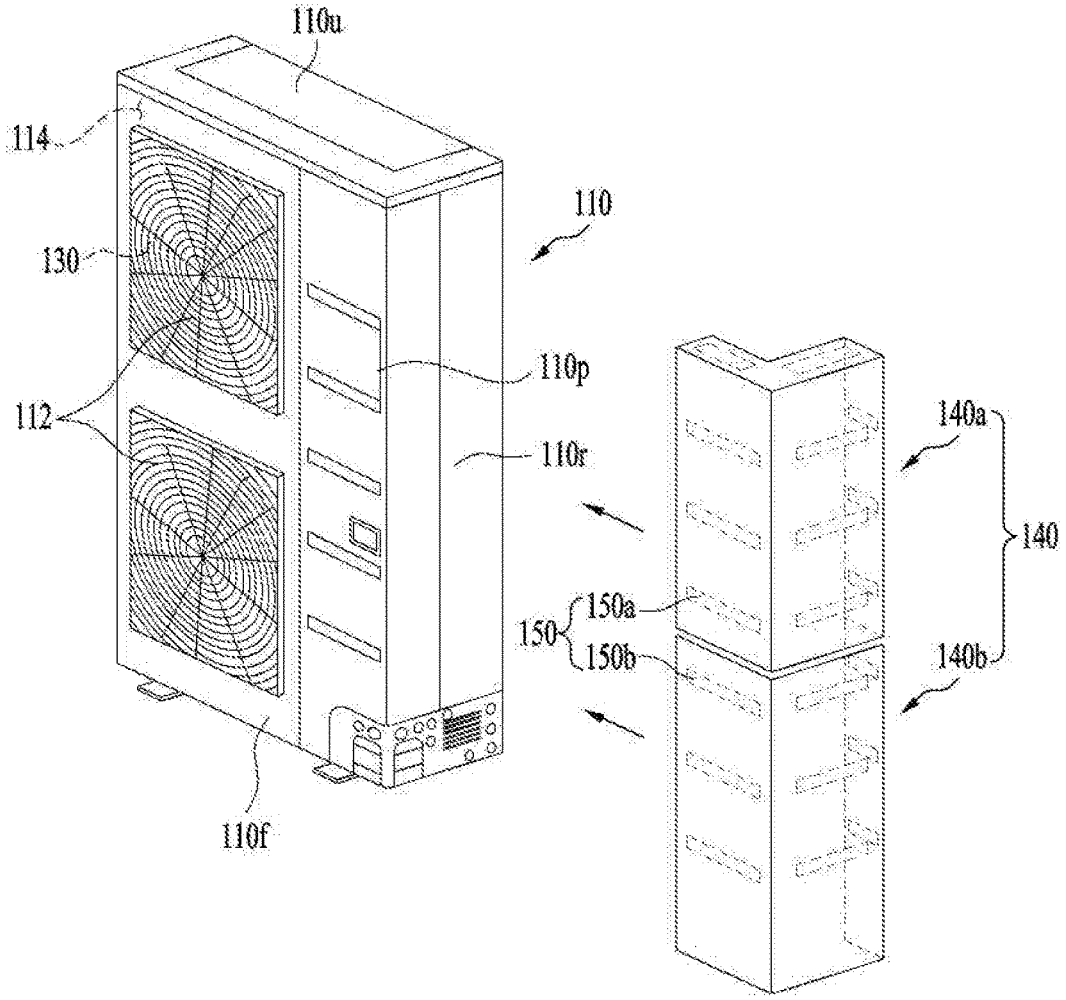
FIG. 7 is a perspective diagram illustrating one modified example of the cover shown in FIG. 3.

FIG. 7 is a perspective diagram illustrating one modified example of the cover shown in FIG. 3.

Referring to FIG. 7, the cover 140 may include a first sub-cover and a second-sub cover 140*b* that are detachably connected with each other. The first sub-cover 140*a* may cover a predetermined area of the case 110 and the second sub-cover 140*b* may cover another predetermined area of the case 110.

Alternatively, one of the first and second sub-covers 140*a* and 140*b* may cover a side surface of the case 110 and the other one may cover side and upper surfaces of the case 110. In the drawing, the first sub-cover 140*a* may cover the side and upper surfaces of the case 110 and the second sub-cover 140*b* may cover the side surface of the case 110.

As mentioned above, the cover 140 shown in FIGS. 3 through 6 may cover the other area of the outer surface of the case, except the area having the inlet hole 120 and the outlet hole 130. Accordingly, the area covered by the first and second sub-covers 140*a* and 140*b* may be equal to the area covered by the cover 140 shown in FIGS. 3 through 6.

In the drawings, the total size of the first and second covers 140*a* and 140*b* may be equal to the size of the cover 140 shown in FIGS. 3 through 6 but the embodiments are not limited thereto.

As one example, the cover 140 may include a plurality of sub-covers (not shown). In other words, two sub-covers shown in FIG. 7 may be detachably connected with each other like Lego pieces. Even when the size of the outdoor unit 100 is different, such sub-covers may be assembled to each other based on the size of the outdoor unit 100 and attached to or detached from the outdoor unit 100, with no need of fabricating a new cover.

Specifically, the first sub-cover 140*a* and the second sub-cover 140*b* may be formed in a smaller size than the size shown in FIG. 7. Although not shown in the drawing, additional sub-covers may be further provided to cover the side surface or the upper surface of the case 110 (e.g., a third sub-cover and a fourth sub-cover).

Regardless of the number of the sub-covers, the sub-covers may be connected with each other to form one cover assembly (not shown) and the size of the cover assembly may be equal to that of the cover 140 shown in FIGS. 3 through 6 or it may be large enough to cover the other area of the of the outer surface of the case except the area having the inlet hole 120 and the outlet hole 130.

When the cover 140 for covering the case of the outdoor unit 100 is configured of several detachable pieces like Lego pieces, a new cover 140 for a different-sized outdoor unit 100 designed based on the needed heating or cooling capacity may not be fabricated and the manufacturing cost of the cover 140 may be saved. In addition, several covers 140, in other words, the first and second sub-covers 140*a* and 140*b* may be assembled based on the size of the outdoor unit 100 to be attached to and detached from the outdoor unit 100. Accordingly, the cover 140 may have versatile utility.

Hereinafter, referring to FIGS. 8 to 14, the structure and effect of the space where the magnetic member 150 is disposed between the case 110 and the cover 140 will be described in detail.

Figure 8:
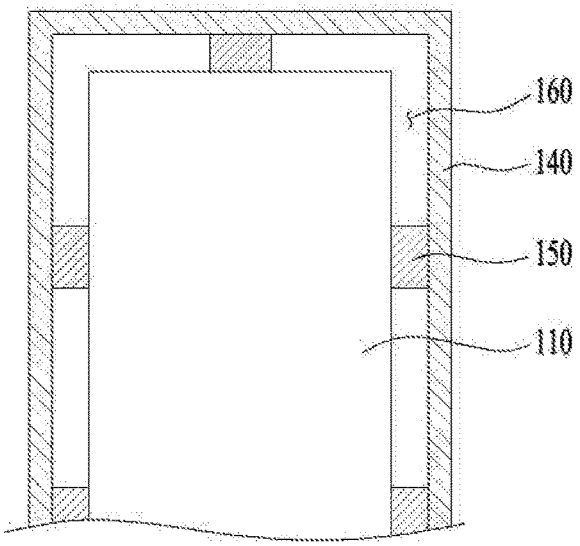
FIG. 8 is a cut-away view partially illustrating the cover and the outdoor unit shown in FIG. 3.

FIG. 8 is a cut-away view partially illustrating the cover and the outdoor unit shown in FIG. 3.

Referring to FIG. 8, the plurality of the magnetic members 150 may be disposed between the case 110 of the outdoor unit 100 and the cover 140 at predetermined intervals.

Air may be filled in the other empty space between the case 110 and the cover 140 except the space having the magnetic members 150. In other words, the case 110 and the cover 140 may be spaced as apart as the thickness of the magnetic members. An air layer 160 may be formed in the space formed between the case and the cover 140 by the magnetic members 150.

The air layer 160 formed between the case 110 and the cover 140 may reduce the noise generated in the inner space of the outdoor unit 100, especially, the curved space of the compressor 104 and the refrigerant pipe unit 300 installed in the mechanism chamber 116.

Figure 9:
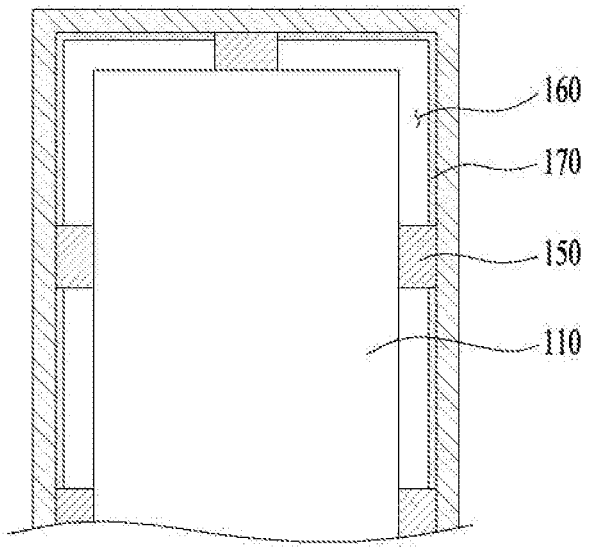
FIG. 9 is a cut-away view illustrating a sound-proof material provided on an inner surface of the cover, as another modified example of a coupling structure between the cover and the outdoor unit of FIG. 8 and a magnetic member.

FIG. 9 is a cut-away view illustrating a sound-proof material provided on an inner surface of the cover, as another modified example of a coupling structure between the cover and the outdoor unit of FIG. 8 and a magnetic member.

Referring to FIG. 9, a sound-proof material 170 may be provided in the other space between the case 110 and the cover 140 except the area having the magnetic members. Specifically, the sound-proof material 170 may include a sound absorbent material for absorbing noise and vibration and a sound insulation material for insulating noise.

The sound absorbent material is a material for absorbing noise and vibration. The sound insulating material is a material for insulating noise to reduce the noise transmitted there through. The sound-proof material 170 including the sound absorbent material and the sound insulating material may be disposed between the case 110 and the cover 140 to effectively reduce the noise and vibration generated in the inner space of the outdoor unit 100.

Meanwhile, the sound-proof material 170 shown in FIG. 9 may be coupled to the inner surface of the cover 140, spaced a preset distance apart from the case 110. In this instance, an empty space may be formed between the case 110 and the sound-proof material 170 and an air layer 160 may be formed in the empty space. Under such a structure, the noise and vibration generated in the outdoor unit 100 may be sequentially reduced by the air layer 160 and the sound-proof material 170.

Instead of the air layer 160, the sound-proof material 170 or the meta material (180, see FIG. 10) may be filled in the empty space formed between the case 110 and the sound-proof material 170. Such a structure will be described, referring to FIG. 10.

Figure 10:
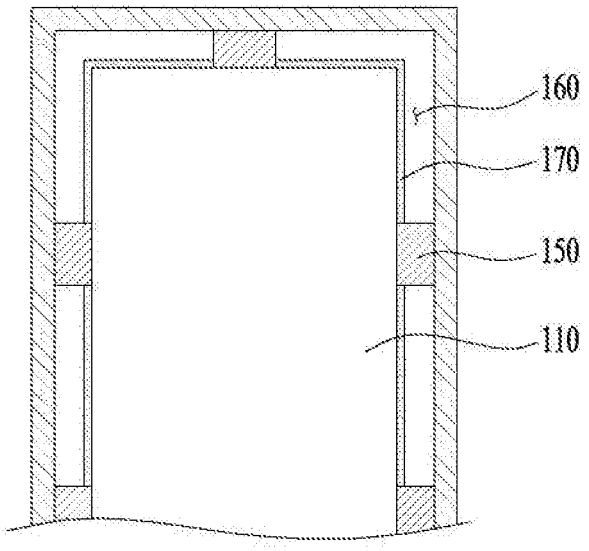
FIG. 10 is a cut-away view illustrating the sound-proof material that is provided on an outer surface of the case provided in the outdoor unit, as another modified example of the sound-proof material shown in FIG. 9.

FIG. 10 is a cut-away view illustrating the sound-proof material that is provided on an outer surface of the case provided in the outdoor unit, as another modified example of the sound-proof material shown in FIG. 9.

Referring to FIG. 10, the sound-proof material 170 may be spaced a preset distance apart from the inner surface of the cover 140 and contact with an outer surface of the case 110 when the cover 140 is attached to the case 110. In this instance, the air layer 160 may be formed in the other empty space between the cover 140 and the sound-proof material 170 except the area having the magnetic materials 150. Under the structure, the noise and vibration generated in the outdoor unit 100 may be reduced by the sound-proof material 170 and the air layer 160 sequentially.

Instead of the air layer 160, the sound-proof material 170 or the meta material (180, see FIG. 10) may be filled in the empty space formed between the case 110 and the sound-proof material 170. Such a structure will be described, referring to FIG. 10.

Figure 11:
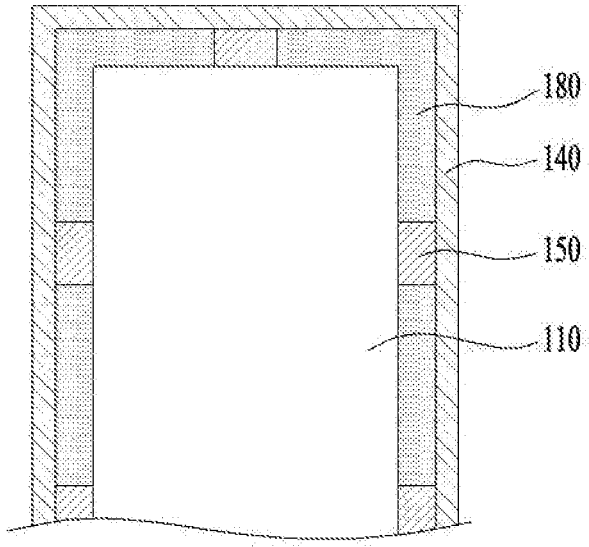
FIG. 11 is a cut-away view illustrating a meta material that is filled in the other empty space except a space between the case and the cover where the magnetic member is disposed, as another example of the coupling structure between the cover and the outdoor unit of FIG. 8 and the magnetic member.

FIG. 11 is a cut-away view illustrating a meta material that is filled in the other empty space except a space between the case and the cover where the magnetic member is disposed, as another example of the coupling structure between the cover and the outdoor unit of FIG. 8 and the magnetic member.

Referring to FIG. 11, the sound-proof material 170 or the meta material 180 may be filled in the other entire area between the case 110 of the outdoor unit 100 and the cover 140, except the area having the magnetic members 150. In other words, different from FIGS. 8 through 10, FIG. 11 shows the structure that the sound-proof material 170 or the meta material 180 may be full-filled in the other empty space except the area having the magnetic member 150 between the case 110 and the cover 140, without the air layer 160.

Figure 12:
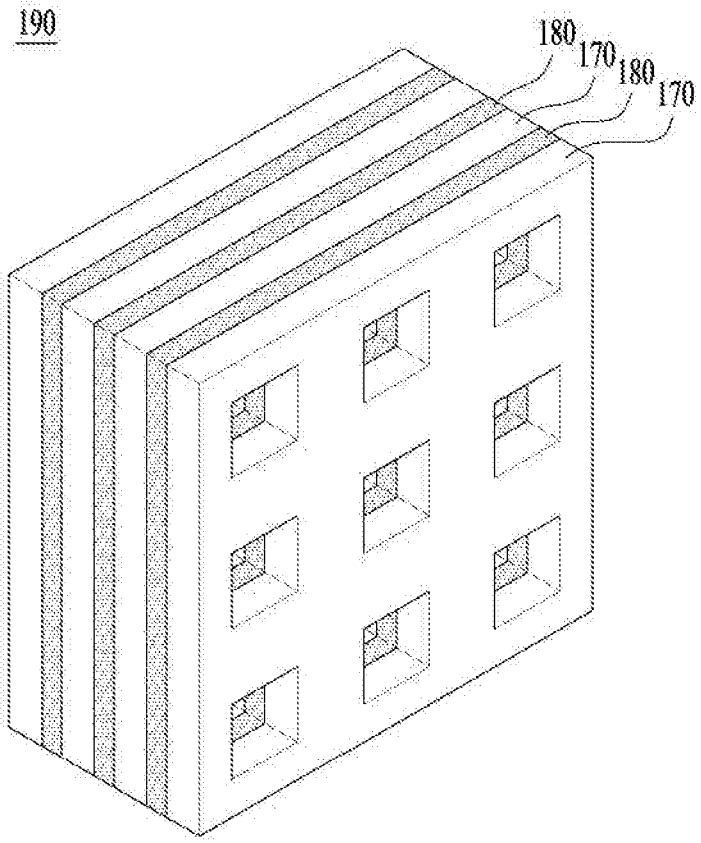
FIG. 12 is a perspective diagram illustrating a porous structure configured of the sound-proof material and the meta material that is alternately disposed.
Figure 13:
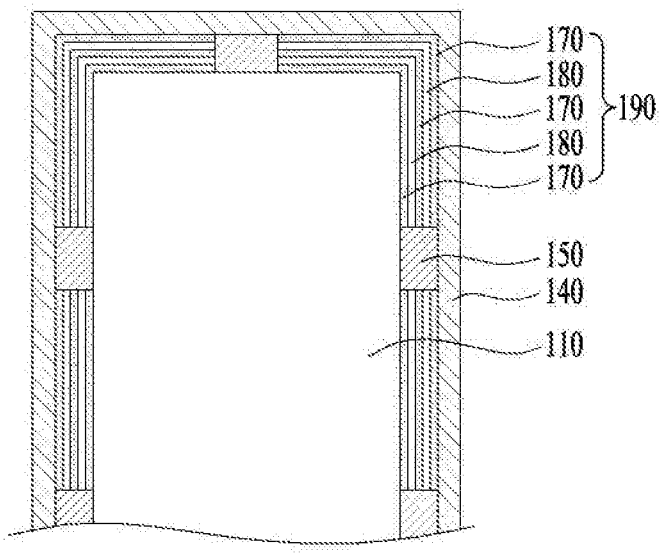
FIG. 13 is a cut-away view illustrating the porous structure of FIG. 12 that is disposed between the cover and the case in the outdoor unit.

FIG. 12 is a perspective diagram illustrating a porous structure configured of the sound-proof material and the meta material that is alternately disposed. FIG. 13 is a cut-away view illustrating the porous structure of FIG. 12 that is disposed between the cover and the case in the outdoor unit.

Referring to FIGS. 12 and 13, the outdoor unit 100 may be installed in the other empty space except the area having the magnetic member 150 between the case 110 and the cover 140. The sound-proof material 170 and the meta material 180 may be alternately layered in a direction from the case 110 towards the cover 140. A porous structure 190 having a plurality of air layers may be further provided between the case 110 and the cover 140.

Under the structure, the noise and vibration generated in the outdoor unit 100 may be reduced while passing through the continuous multi-layered structure configured of the sound-proof material 170 and the meta material 180 and also by the air layer 160.

Referring to FIGS. 3 through 14, the coupling structure among the case 110 and the cover 140, the magnetic member 150, the air layer 160, the sound-proof material 170, the meta material 170 and the porous structure 190 may be applicable to the outdoor unit 100 shown in FIGS. 1 and 2.

In other words, the air conditioner 50 according to one embodiment of the present disclosure may include the outdoor unit 100 including the case 110 defining the exterior design and having the heat-exchanging chamber 114 and the mechanism chamber 116; an inlet hole 120 formed through the case and providing a path of the external air drawn into the heat-exchanging chamber 114; the outlet hole 130 formed through the case 110 and providing a path of the external air discharged outside the heat-exchanging chamber 114 again after drawn into the heat-exchanging chamber 114; and the cover 140 configured to cover the other area of the outer surface of the case 110 except the area having the inlet 120 and the outlet 130; and the indoor unit 200 connected with the outdoor unit 100 via the refrigerant pipe unit 300 and configured to exchange heat between room air and the refrigerant transmitted from the outdoor unit 100 and transmit the refrigerant to the outdoor unit 100 again. The case 110 and the cover 140 may be spaced apart from each other by means of the magnetic member 150 disposed between the case 110 and the cover 140. The indoor unit 200 may provide the cooling function when the refrigerant passing the indoor unit 200 absorbs heat from the room air and the heating function to the room when the refrigerant passing the indoor unit 200 supplies heat to the room.

As mentioned above, the outdoor unit 100 and the air conditioner 50 including the outdoor unit 100 may easily attach or detach the cover 140 for reducing the noise and vibration of the outdoor unit 100 to or from the case 110. Accordingly, the user's or service technician's working convenience may be enhanced.

Furthermore, the noise and vibration generated in the outdoor unit 100 may effectively reducing by filling the air layer 160 or the sound-proof or meta material 170 or 180 in the empty space formed between the case 110 and the cover 140 as much as the thickness of the magnetic member 150.

In addition, the case 110 configured of several parts like Lego may be formed to cover the case 110, with no need of the new cover. Accordingly, the manufacturing cost may be reduced. Also, such the covers 140 may be assembled based on the size of the outdoor unit 110 properly to be attached to or detached from the outdoor unit 100. Accordingly, the cover 140 may be versatile.

In addition the noise and vibration generated in the outdoor unit 100 may be effectively reduced, through interfering win a path of external air passing the outdoor unit 100, by attaching the cover 140 to the other outer surface of the case 110 except the inlet hole 120 for sucking the external air and the outlet hole 130 for discharging the air sucked into the outdoor unit 100.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. An outdoor unit of an air conditioner, the outdoor unit comprising:

a case that defines an exterior of the outdoor unit, the case including a heat-exchanging chamber and a mechanism chamber;

an inlet hole located on the case and configured to provide a path for external air to flow into the heat-exchanging chamber;

an outlet hole located on the case and configured to provide a path for the internal air to flow out of the heat-exchanging chamber;

a cover configured to cover an outer surface of the case that forms the mechanism chamber, the outer surface of the case that forms the mechanism chamber excluding the inlet hole and the outlet hole; and a magnetic member located between the case and the cover, and configured to attach the cover to the case by a magnetic force generated by the magnetic member, wherein the case and the cover, based on the magnetic member being located there between, are spaced apart a preset distance, wherein at least one of a sound-proof material or a meta material is filled in an empty space between the case and the cover, wherein the sound-proof material is configured to reduce noise and vibration generated from the outdoor unit, and wherein the meta material has a low refractive index and is configured to restrict sound waves emitting from the outdoor unit.

2. The outdoor unit of claim 1, wherein the cover comprises a first sub-cover and a second sub-cover that are detachably connected with each other, and wherein the first sub-cover covers a first predetermined area of the case and the second sub-cover covers a second predetermined area of the case, and the first sub-cover covers at least a side surface of the case and the second sub-cover covers at least an upper surface of the case.

3. The outdoor unit of claim 1, wherein the magnetic member is coupled to an inner surface of the cover.

4. The outdoor unit of claim 1, wherein the magnetic member extends in a first direction on the cover, wherein the outdoor unit further comprises a plurality of magnetic members that are spaced apart in preset intervals and that are arranged in parallel along a second direction, and wherein the second direction is orthogonal to the first direction.

5. The outdoor unit of claim 1, wherein the sound-proof material comprises a sound absorbent material that absorbs noise and vibration, and a sound insulating material that insulates noise.

6. The outdoor unit of claim 1, wherein the sound-proof material is coupled to an inner surface of the cover, and is spaced apart from the case a preset distance.

7. The outdoor unit of claim 6, wherein air is filled in an empty space between the sound-proof material and the case.

8. The outdoor unit of claim 1, wherein the sound-proof material, based on the cover being attached to the case, is spaced apart a preset distance from an inner surface of the cover and is in contact with an outer surface of the case.

9. The outdoor unit of claim 8, wherein air is filled in an empty space between the cover and the sound-proof material.

10. The outdoor unit of claim 1, wherein the meta material is coupled to an inner surface of the cover and spaced apart from the case a preset distance.

11. The outdoor unit of claim 10, wherein air is filled in an empty space between the meta material and the case.

12. The outdoor unit of claim 1, wherein the meta material, based on the cover being attached to the case, is spaced apart from an inner surface of the cover a preset distance, and is in contact with an outer surface of the case.

13. The outdoor unit of claim 12, wherein air is filled in an empty space between the cover and the meta material.

14. The outdoor unit of claim 8, further comprising:

a porous structure located in the empty space between the case and the cover, wherein the porous structure includes the sound-proof material and the meta material alternately layered on each other along a direction from the outer surface of the case to the inner surface of the cover, and wherein the porous structure further includes a plurality of empty spaces that are formed between the case and the cover, the empty spaces being filled by air.

15. An air conditioner comprising:

an outdoor unit comprising a case that defines an exterior of the outdoor unit, the case including a heat-exchanging chamber and a mechanism chamber; an inlet hole located on the case and configured to provide a path for external air to flow into the heat-exchanging chamber; an outlet hole located on the case and configured to provide a path for internal air to flow out of the heat-exchanging chamber; a cover configured to cover an outer surface of the case that forms the mechanism chamber, the outer surface of the case that forms the mechanism chamber excluding the inlet hole and the outlet hole; and a magnetic member located between the case and the cover, and configured to attach the cover to the case by a magnetic force generated by the magnetic member; and an indoor unit connected with the outdoor unit via a refrigerant path and configured to circulate refrigerant flow between the outdoor unit and the indoor unit to exchange heat between internal air in the indoor unit and the refrigerant, wherein the case and the cover, based on the magnetic member being located there between, are spaced apart a preset distance, wherein the indoor unit is configured to provide cooling by passing refrigerant through the indoor unit to absorb heat therein, and to provide heating by passing refrigerant through the indoor unit to supply heat, wherein the case and the cover, based on the magnetic member being located there between, are spaced apart a preset distance, wherein at least one of a sound-proof material or a meta material is filled in an empty space between the case and the cover, wherein the sound-proof material is configured to reduce noise and vibration generated from the outdoor unit, and wherein the meta material has a low refractive index and is configured to restrict sound waves emitting from the outdoor unit.

16. The air conditioner of claim 15, wherein the sound-proof material is configured to reduce noise and vibration generated from the outdoor unit, and wherein the meta material has a low refractive index and is configured to restrict sound waves emitting from the outdoor unit.

17. The air conditioner of claim 15, wherein the cover comprises a first sub-cover and a second sub-cover that are detachably connected with each other, and wherein the first sub-cover covers a first predetermined area of the case and the second sub-cover covers a second predetermined area of the case, and the first sub-cover covers at least a side surface of the case and the second sub-cover covers at least an upper surfaces of the case.

* * * * *